United States Patent [19]

Droske, Jr.

[11] Patent Number: 4,790,535

[45] Date of Patent: Dec. 13, 1988

[54] APPARATUS FOR PLAYING MARBLES

[76] Inventor: Edward J. Droske, Jr., 5120 W. Cornelia Ave., Chicago, Ill. 60641

[21] Appl. No.: 878,013

[22] Filed: Jun. 24, 1986

[51] Int. Cl.[4] ..... A63D 3/00; A63D 5/02

[52] U.S. Cl. ..... 273/118 R; 273/48; 273/122 R

[58] Field of Search ..... 273/118 R, 121 R, 122 R, 273/127 R, 127 C, 124 R, 39, 53, 119 R, 48

[56] References Cited

U.S. PATENT DOCUMENTS

| | | | |
|---|---|---|---|
| 2,468,979 | 5/1949 | Howard | 273/127 R |
| 2,630,322 | 3/1953 | Endriss | 273/127 R |
| 3,079,155 | 2/1963 | Koelliker | 273/53 |
| 3,902,720 | 9/1975 | Collins | 273/53 |

*Primary Examiner*—Richard C. Pinkham
*Assistant Examiner*—Gary Jackson
*Attorney, Agent, or Firm*—Hill, Van Santen, Steadman & Simpson

[57] ABSTRACT

An apparatus for playing marbles comprising a surface for supporting a plurality of marbles, the surface extending from a front end of the apparatus and terminating before a back wall of the apparatus. A chute for capturing marbles that are propelled off the back end of the surface is provided. The chute includes a back wall, a pair of side walls, a top plate, and an inclined plate extending from the top wall to the back wall. The apparatus includes an inclined floor for returning marbles from the chute to the front end of the apparatus.

17 Claims, 1 Drawing Sheet

FIG. 1
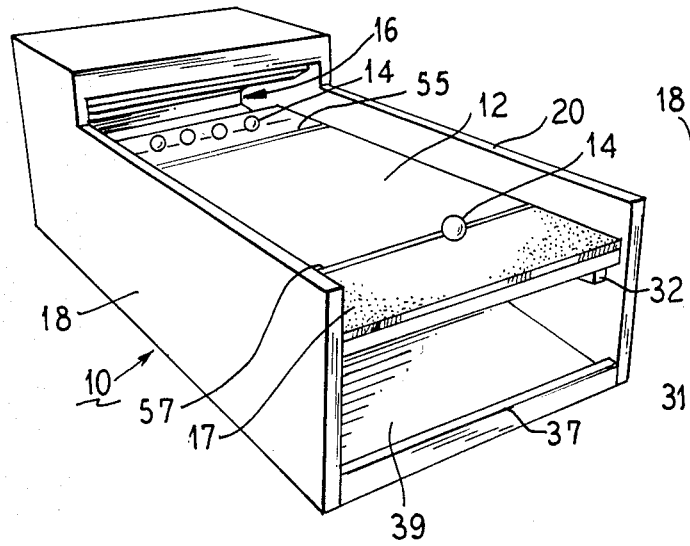
FIG. 3
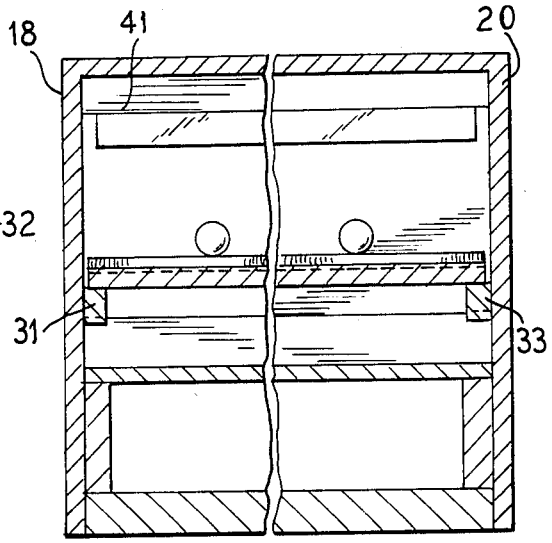
FIG. 2
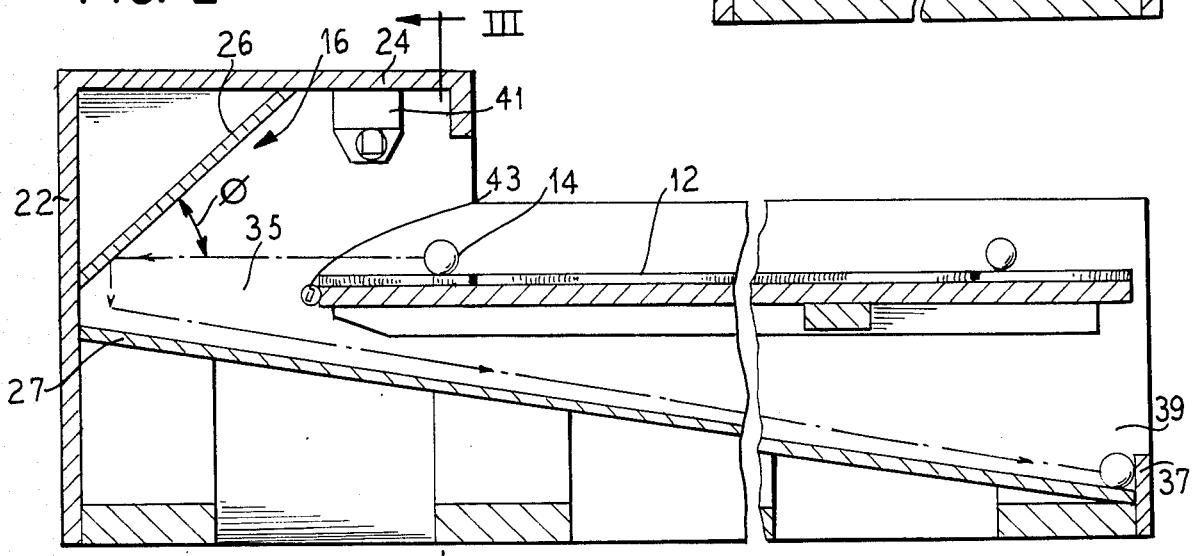
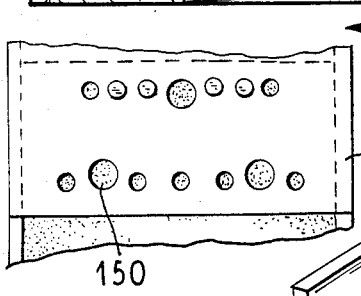
FIG. 5
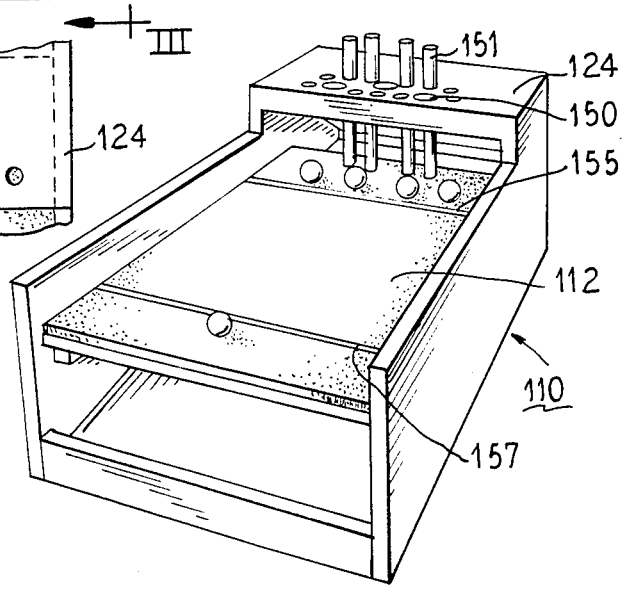
FIG. 4

APPARATUS FOR PLAYING MARBLES

BACKGROUND OF THE INVENTION

This invention relates generally to apparatus for playing games and methods of using same. More specifically, this invention relates to structures and apparatus for playing games utilizing spherical members and methods of utilizing same.

A few years ago, one of the more popular games, especially among children, was the game of marbles. Marbles are spherical members that can be found in assorted colors and sizes. There are a variety of different games that can be played with marbles. Perhaps, in its simplest form, the game of marbles entails the propelling by a player of a marble towards other marbles. A typical ga requires that the object marble be driven past a line or out of a circle by the propelled marble.

In recent time, the popularity of marbles has waned. Indeed, the game of marbles is somewhat of an anachronism. In fact, the game of marbles has reached such a state of unpopularity, that it is difficult to find marbles of varying sizes and shapes. Marbles are typically now only sold as decorating items and such, for example, to support artificial plants in a planter.

It is believed that one of the reasons for the decline in the popularity of marbles is the required playing surface. Marbles usually must be played on a substantially smooth or flat surface. Accordingly, marbles were usually played outdoors on a sidewalk, playground or other flat surface. Moreover, because the game was played outside on, for example a sidewalk the participants wee required to sit or kneel on the ground.

Another disadvantage of prior marble games and playing surfaces is the fact that during most marble games it is necessary to retrieve the propelled marble as well as the object marbles that are struck. Thus, if barriers are not placed around the playing surface, one is forced to constantly scramble after his marbles. This can be especially frustrating after an errant shot.

Because of these and other drawbacks, the game of marbles has steadily declined while video games and other traditional recreational room games such as pool and table tennis have increased in popularity. Video games and other recreational games afford the user the ability to play games indoor in typically more comfortable positions than kneeling on a cement or asphalt surface. Accordingly, the game of marbles has almost reached a state of nonexistance.

Therefore, there is a need for an apparatus that improves on the basic game of marbles.

SUMMARY OF THE INVENTION

An apparatus for playing marbles is provided. The apparatus includes a surface for supporting a plurality of marbles, the surface extending from an open face in the front of the apparatus and terminating before a back wall. Located at the back wall is a chute for capturing marbles that are propelled off the back end of the surface. An inclined floor for directing captured marbles to a front of the apparatus is also provided.

Preferably, the chute is defined by side walls, a top plate, an inclined plate and the inclined floor. The inclined plate extends from the top plate to the back wall and the inclined floor from the back wall to the front of the apparatus.

Preferably, the floor includes at a front end a stop plate. Preferably, the top plate includes a light for illuminating a portion of the surface. Moreover, preferably the top plate, in an embodiment of the invention, includes apertures for receiving obstacle members.

Accordingly, it is an advantage of the present invention to provide an apparatus for playing a game utilizing marbles.

Another advantage of the present invention is to provide a playing surface for playing marbles that can be supported on the ground or on a table depending on where one wants to play the game.

A further advantage of the present invention is to provide an apparatus for playing a game utilizing marbles that provides an automatic return of the marbles to the player.

A still further advantage of the present invention is to provide an apparatus that allows one to play a multitude of games utilizing marbles.

A still further advantage of the present invention is to provide an apparatus that includes obstacles that can provide variations on the games played thereon.

Additional features and advantages are described in, and will be apparent from, the detailed description of the presently preferred embodiments and from the drawings.

BRIEF DESCRIPTION OF THE DRAWINGS

FIG. 1 illustrates a prespective view of an embodiment of the apparatus of the present invention.

FIG. 2 illustrates a cross-sectional view of the embodiment of the invention of FIG. 1.

FIG. 3 illustrates a cross-sectional view of the embodiment of the invention illustrated in FIG. 1 taken along lines III—III of FIG. 2.

FIG. 4 illustrates a perspective view of a further embodiment of the present invention.

FIG. 5 illustrates a top elevational view of a portion of the invention illustrated in FIG. 4.

DETAILED DESCRIPTION OF THE PRESENTLY PREFERRED EMBODIMENTS

Referring to FIG. 1, the apparatus for playing marbles 10 is illustrated. As used herein, the term "marbles" refers to a spherical object of varying shapes and colors that is propelled towards another like object either manually or with the assistance of a machine or other means such as a stick.

The apparatus for playing marbles 10 includes a surface 12 on which the marbles 14 are supported. The surface 12 is preferably a substantially flat surface with a sufficiently low coefficient of friction with respect to the marbles 14 so that marbles can be propelled across the surface. To this end, the surface 12 can be finished wood, wood covered with a covering, for example, polyurethane or carpet, plastic, or like materials. Of course, the surface 12 can also include ornamental designs or logos. It is envisioned that the surface 12 will include markings, such as lines, for assisting one in playing games on the apparatus for playing marbles 10.

The apparatus for playing marbles 10 includes a front open face 17. The surface 12 for supporting marbles extends from the front open face 17 to a chute member 16. As illustrated, a stop member 43 may be located within the chute 16 to position the marble surface 12 within the chute.

As illustrated in FIG. 2, the chute member 16 functions, in part, to capture the marbles that are propelled off the surface 12. To this end, the chute member 16 is defined, in part, by side walls 18 and 20, a back wall 22 and a top plate 24. The side walls 18 and 20 extend from the chute member 16 to the front open face 17 of the apparatus for playing marbles 10. The side walls 18 and 20 function, in part, to support the marble support surface 12. To this end, the surface 12 is supported by flange members 30, 31, 32, and 33 extend from side walls 18 and 20 respectively. Of course, the apparatus for playing marbles 10, can be constructed so that the side walls 18 and 20 of the chute 16 are not integral with the remaining side walls of the apparatus for playing marbles 10.

The chute member 16 is also defined by an inclined plate 26 and inclined floor member 27. The inclined plate 26 extends from the top member 24 to the back wall member 22 and the inclined floor 27 extends from the front open face 17 to the back wall 22. The marble surface 12 is located so that there is a space 35 between the surface 12 and the inclined plate 26 and back wall 22. As illustrated in FIG. 2, because of this construction, when a marble 14 has been propelled on the surface 12 and strikes the plate 26 it is directed through the space 35 to the inclined floor member 27. It has been found, that preferably the impact angle $\phi$ i.e., the angle of the inclined plate 26 with respect to the marble surface 12, is acute. Preferably the angle $\phi$ is between approximately 40° to about 50°.

As previously stated, preferably, the floor member 27 is inclined upwardly from the open front face 17 of the apparatus for playing marbles 10 to the back wall 22. Preferably, the floor member 27 is inclined at an acute angle. Accordingly, as illustrated in FIG. 2, marbles 14 will roll from the chute member 16 to the open front face 17 in the apparatus. Accordingly, an automatic return of marbles 14 that are propelled into the chute 16 is provided. Extending from the inclined floor 27 at the front open face is a retaining wall or stop plate 37. The retaining wall 37 cooperates with the open front face 17 of the apparatus for playing marbles 10 to define an open area 39 that allows one to access the marbles 14 when they are returned. To this end, the chute 16 and inclined floor 27 cooperate to capture marbles that are propelled along the surface 12 and return them to the front of the apparatus 39 where the retaining wall 37 will retain the marbles 14 until the user wishes to remove the marbles.

The apparatus for playing marbles 10 is constructed so that it can be supported on any substantially flat surface. Indeed, if desired, the apparatus for playing marbles can include legs (not shown) and therefor be self-supporting. The apparatus for playing marbles 10 can be constructed from wood, plastic, or like material.

In the embodiment illustrated in FIGS. 1, 2 and 3, the chute member 16, and specifically the top panel 24, includes a light 41. The light 41 is oriented so that it illuminates a portion of the marble surface 12 and the chute area 16. As illustrated, the light 41 can include a florescent bulb that is enclosed by a plastic shield. Of course, other lighting means known in the art can be utilized.

Referring now to FIGS. 4 and 5, a further embodiment 110 of the apparatus for playing marbles is illustrated. The apparatus is substantially the same as the previously discussed apparatus for playing marbles 10 except that the top panel 124 includes a plurality of apertures 150 through which a plurality of vertical post members 151 can be inserted. The vertical post members 151 provide a variation on the games that can be played on the apparatus for playing marbles 110. To this end, the vertical post members 151 provide an obstacle to either hitting the object marbles or propelling the object marbles off the surface 112. Of course, although 14 apertures 150 are illustrated more or less apertures can be utilized.

An example of a game that can be played on the apparatus 10 is as follows. Two racks of different colored marbles 14 are positioned on opposite sides of the marble surface 12 behind a line 55. Players alternate, from behind a line 57, propelling their strike marble at the object marbles. The players take turns propelling their strike marble until one player has knocked all of his color object marbles 14 off the marble surface 12 into the chute are 16.

A variety of other games are envisioned. Some of these games can parallel pocket billiards such as a game similar to eight-ball, or a game similar to rotation. Moreover, by using a variety of different size marbles, a variety of different games can be defined and played.

It should be understood that various changes and modifications to the preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. An apparatus for playing a game comprising:

a surface for supporting a plurality of marbles, the surface extending from a front end of the apparatus and terminating before a back wall of the apparatus;

a chute for capturing marbles that are propelled towards the back wall off the surface, the chute being defined, in part, by the back wall, a pair of side walls, a top plate, and a plate extending from the top plate to the back wall, the plate extending from the back wall and top plate at an included angle that is acute, the inclined plate intersecting a plane defined by the surface for supporting; and an inclined floor for returning the marbles from the chute area to the front end of the apparatus.

2. The apparatus of claim 1 wherein the plate intersects the plane defined by the surface for supporting at an acute angle.

3. The apparatus of claim 1 wherein the front end of the apparatus includes a stop plate extending upwardly from the floor for retaining marbles.

4. The apparatus of claim 1 wherein the top plate includes a plurality of apertures for receiving elongated post members.

5. The apparatus of claim 1 wherein the top plate includes means for illuminating the chute area and a portion of the surface.

6. An apparatus for playing marbles comprising:

a pair of side walls extending from a front of the apparatus to a back wall;

a surface for supporting a plurality of marbles disposed between the side walls, the surface extending from the front of the apparatus and terminating before the back wall, the back wall and surface defining a space therebetween;

a top plate extending from the back wall over a portion of the surface;

an inclined floor for returning marbles that are received by said space to the front of the apparatus; and a plate extending from the top plate to the back wall, the plate directing marbles propelled off a back end of said surface into said space, the plate intersecting a plane defined by said surface for support.

7. The apparatus of claim 6 wherein the plate intersects the plane defined by the surface supporting at an acute angle.

8. The apparatus of claim 6 wherein the plate extends from the back wall at an acute angle with respect to the surface for supporting.

9. The apparatus of claim 6 including a stop plate at the front of the apparatus extending from the floor between the side walls.

10. The apparatus of claim 6 wherein the top plate includes a plurality of apertures for receiving post members.

11. The apparatus of claim 6 wherein the surface has a sufficiently low coefficient of friction to allow marbles to be propelled thereon.

12. The apparatus of claim 6 wherein the top plate includes a light for illuminating a portion of the surface.

13. An apparatus for playing marbles thereon comprising:

a pair of side walls extending from a front of the apparatus to a back wall;

an inclined floor extending from the front of the apparatus to the back wall;

a surface for supporting marbles disposed between the side walls, the surface and back wall defining a space therebetween for receiving marbles;

a top plate extending from the back wall over a portion of the surface; and a plate extending from the top plate to the back wall for directing marbles propelled off the surface into the space, the plate extending from the top plate and back wall at an included angle that is acute and intersecting a plane defined by the top surface at an acute angle.

14. The apparatus of claim 13 wherein extending upwardly from a front end of the floor is a stop plate for retaining marbles.

15. The apparatus of claim 13 wherein the top plate includes a plurality of apertures.

16. The apparatus of claim 13 wherein the floor is inclined from the front end of the apparatus to the back wall at an acute angle.

17. The apparatus of claim 13 wherein the top plate includes a light for illuminating a portion of the surface.

* * * * *